US006279544B2

(12) United States Patent
Rumpf

(10) Patent No.: US 6,279,544 B2
(45) **Date of Patent: *Aug. 28, 2001**

(54) PRESSURE-MAINTAINING ARRANGEMENT

(75) Inventor: Bernd Rumpf, Nidderau (DE)

(73) Assignee: Mannesmann VDO AG, Frankfurt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/214,664

(22) PCT Filed: Mar. 22, 1997

(86) PCT No.: PCT/EP97/01474

§ 371 Date: Jun. 7, 1999

§ 102(e) Date: Jun. 7, 1999

(87) PCT Pub. No.: WO98/01664

PCT Pub. Date: Jan. 15, 1998

(30) Foreign Application Priority Data

Jul. 10, 1996 (DE) ..... 196 27 741

(51) Int. Cl.[7] ..... F03M 33/04
(52) U.S. Cl. ..... 123/511; 123/497; 123/458
(58) Field of Search ..... 123/457, 458, 123/497, 510, 511; 417/44.1, 44.2, 44.7, 44.9, 44.11

(56) References Cited

U.S. PATENT DOCUMENTS

| | | | | |
|---|---|---|---|---|
| 1,837,504 | | 12/1931 | Tice . | |
| 2,384,894 | | 9/1945 | Curtis . | |
| 3,824,974 | | 7/1974 | La Flame et al. . | |
| 4,722,312 | * | 2/1988 | Yamada et al. | 123/458 |
| 4,728,264 | | 3/1988 | Tuckey . | |
| 4,756,291 | * | 7/1988 | Cummins et al. | 123/497 |
| 5,133,323 | | 7/1992 | Treusch . | |
| 5,367,999 | * | 11/1994 | King et al. | 123/458 |
| 5,411,002 | | 5/1995 | Smitley . | |
| 5,471,959 | * | 12/1995 | Sturman | 123/497 |
| 5,483,940 | * | 1/1996 | Namba et al. | 123/497 |
| 5,501,196 | * | 3/1996 | Brunnhofer | 123/497 |
| 5,535,621 | * | 7/1996 | Glidewell et al. | 73/119 A |
| 5,579,738 | * | 12/1996 | Frischmuth et al. | 123/497 |
| 5,649,561 | * | 7/1997 | Brandt | 123/511 |
| 5,765,535 | * | 6/1998 | Radermacher | 123/467 |
| 5,785,025 | * | 7/1998 | Yoshiume et al. | 123/497 |

FOREIGN PATENT DOCUMENTS

| | | |
|---|---|---|
| 106216 | 5/1974 | (DE) . |
| 4311731 | 10/1994 | (DE) . |
| 29509774 | 10/1995 | (DE) . |
| 0147026 | 10/1984 | (EP) . |
| 1189389 | 12/1957 | (FR) . |
| 2476222 | 2/1981 | (FR) . |
| 2695964 | 8/1993 | (FR) . |
| 60-228759 | 11/1985 | (JP) . |
| 9200216 | 11/1992 | (WO) . |

* cited by examiner

*Primary Examiner*—Thomas N. Moulis
(74) *Attorney, Agent, or Firm*—Mayer, Brown & Platt

(57) ABSTRACT

In a pressure-maintaining device for a fuel supply system of an internal combustion engine (1) of a motor vehicle, a pressure reservoir (5) is arranged in a supply line (7) leading to the internal combustion engine (1). The pressure reservior (5) has a pressure chamber (13), which is bounded by a movable wall (14) that is pretensioned by a compression spring (15). The position of the movable wall (14) is registered by a displacement transducer (18) and forwarded to a regulating device (12). The regulating device (12) regulates the rotational speed of a fuel pump (3) as a function of the position of the movable wall (14).

30 Claims, 2 Drawing Sheets

PRESSURE-MAINTAINING ARRANGEMENT

BACKGROUND

1. Field of the Invention

Pressure-maintaining device The invention relates to a pressure-maintaining device for a fuel supply system of an internal combustion engine of a motor vehicle, having a pressure reservoir which is intended to be connected to a supply line between a fuel pump and the internal combustion engine, has a pressure chamber, has a pretensioned, movable wall in order to bound a volume of fuel in the pressure chamber and has means for registering the position of the movable wall, it being possible for the fuel pump to be regulated by means of a regulating device as a function of the position of the movable wall.

2. Related Art

It is well know to insert pressure regulators into fuel supply systems wherein the regulators regulate a fuel pump as a function of the position of the diaphragm of the pressure regulator (See, for example, U.S. Pat. No. 3,824,974; U.S. Pat. No. 1,837,504; U.S. Pat. No. 4,728,264). The disadvantage of these arrangements is that, in spite of the fuel pump being regulated, pressure fluctuations in the fuel supply system occur because of internal and external influences.

Such fuel supply systems are already used experimentally in motor vehicles and are therefore known. The pressure reservoir is used for the intermediate storage of fuel and permits cyclic operation of the fuel pump. The pressure reservoir has two limit switches which limit the reciprocating travel of the movable wall. As soon as the pressure chamber has been filled, the regulating device switches off the fuel pump. The internal combustion engine is then supplied with fuel by the pressure reservoir. After the pressure chamber has been virtually completely emptied, the fuel pump is switched on again and supplies the internal combustion engine with fuel. The pressure-maintaining device is used in particular instead of a return line, which is provided to return excess fuel from the internal combustion engine into a fuel tank. By comparison with a fuel supply system having a return line, the pressure-maintaining device has the advantage that the power demand of the fuel pump may be reduced up to 95%. This leads, in particular in city traffic, to a reduction in the fuel consumption of the motor vehicle.

A disadvantage in the case of the known pressure-maintaining device is that, while the fuel pump is operating, a higher pressure prevails in the fuel supply system than when the internal combustion engine is being supplied from the pressure reservoir with the fuel pump switched off. These pressure differences have their origin in the pretensioning forces, which are variable over the reciprocating travel of the movable wall, and in the influence of frictional forces on the movement of the movable wall. Pressure fluctuations in the fuel supply system are produced in this way, and have to be compensated for by a pressure-regulating valve. However, this pressure-regulating valve is a component which is susceptible to faults and very costly.

SUMMARY OF THE PRESENTLY PREFERRED EMBODIMENTS

The invention is based on the problem of configuring a pressure-maintaining device of the type mentioned at the beginning such that it is as cost-effective as possible to produce and, by using it, pressure fluctuations in the fuel supply system can largely be avoided.

According to the invention, this problem is solved by the regulating device being designed to produce a central position of the movable wall.

As a result of this configuration, pressure fluctuations in the fuel supply system are largely avoided without using a pressure-regulating valve, since the pressure chamber initially serves briefly as a buffer for insufficiently or excessively delivered fuel. The movable wall serves as a sensor for the regulating device for regulating the fuel pump to meet the demand. The pressure-maintaining device comprises few components, as a result of omitting the pressure-regulating valve, so that it is particularly cost-effective to produce. The fuel supply system according to the invention is suitable for use in a fuel supply system having an injection system or having a carburetor.

As in the case of the known pressure-maintaining device, the fuel pump could be switched on and of f by switches. For this purpose, these switches would have to be arranged close to the central position of the movable wall. However, this leads to frequent switching of the fuel pump. However, according to an advantageous development of the invention, the pressure-maintaining device does not require frequent switching of the fuel pump, if the position of the movable wall can be ascertained by an electrical displacement transducer, which is connected to the regulating device, and if the delivery of the fuel pump can be regulated by the regulating device. By this means, the fuel supply system according to the invention has a system which regulates the fuel pump as a function of the demand, while the pressure reservoir is used to compensate for pressure fluctuations, caused, for example, by load changes in the internal combustion engine.

According to another advantageous development of the invention, the delivery of the fuel pump may be regulated simply if the rotational speed of the fuel pump can be varied by the regulating device. In this case, it is advantageous if the fuel pump has a flat pump characteristic ($Q=f_{(\omega)}$ at p= const.).

The pressure chamber of the pressure reservoir could be connected, for example via a spur line, to a supply line arranged between the fuel pump and the internal combustion engine. As a result, however, the fuel supply system reacts very sluggishly to pressure fluctuations in the fuel supply system, because of the fuel in the spur line. The pressure-maintaining device reacts particularly rapidly to pressure fluctuations if the pressure chamber has an inlet to connect it to the fuel pump and an outlet to connect it to the internal combustion engine. By this means, the pressure chamber always has fuel flowing through it during operation of the fuel pump. Even in the case of cyclic operation of the fuel pump, this leads only to insignificant pressure fluctuations in the fuel supply system. In addition, the omission of the spur line further simplifies the installation of the pressure-maintaining device.

The movable wall could, for example, bound the upper region of the pressure chamber and, by way of its weight, produce the envisaged pressure in the pressure chamber. As an alternative to this, the movable wall could also be constructed as a float. The pressure provided in the fuel supply system would then be produced by the fuel column. However, this leads to vibration having a great influence on the actuating device. One could also consider producing the envisaged pressure by means of an air pad located in the pressure reservoir. However, such an air pad has the disadvantage of being temperature-dependent and requiring to have the pressure reservoir large dimensions. However, according to another advantageous development of the invention, the pressure-maintaining device has a particularly compact configuration if the movable wall is pretensioned by a spring element. Since, in this case, vibration has only a slight influence on the movable wall, a particularly constant pressure is produced by the spring element in the central position of the movable wall. For the most constant possible pressure over the reciprocating travel of the movable wall in the pressure chamber, it is advantageous, according to another advantageous development of the invention, if the spring element has a particularly flat spring characteristic.

According to another advantageous development of the invention, a fuel column in the pressure chamber counteracts the spring force if the movable wall is arranged in the bottom region of the pressure chamber.

According to another advantageous development of the invention, a fuel column in the pressure chamber has no influence on the pressure produced in the fuel supply system if the movable wall is arranged in a side region of the pressure chamber.

According to another advantageous development of the invention, the movable wall can be produced particularly cost-effectively if the movable wall has a piston.

According to another advantageous development of the invention, any leakage of fuel flowing past the movable wall can be reliably avoided if the movable wall is connected to the pressure chamber by means of a diaphragm.

According to another advantageous development of the invention, the diaphragm is particularly strong if it is a reinforced rubber diaphragm.

According to another advantageous development of the invention, the diaphragm is able to produce the envisaged pressure in the pressure chamber, without any spring element additionally having to be installed, if the diaphragm is produced from sheet metal shaped like a bellows.

For fuel-saving operation of the internal combustion engine, it is necessary that, between an intake pipe and the fuel, a constant relative pressure prevails in an injection nozzle that projects into the intake pipe. According to another advantageous development of the invention, this relative pressure is produced simply by the pressure reservoir having, on that side of its movable wall which faces away from the pressure chamber, a pressure compensation pot, which has a connection to an intake pipe of the internal combustion engine.

According to another advantageous development of the invention, the displacement transducer can be configured particularly simply in design terms if it has a potentiometer. As an alternative to this, the displacement transducer may have an inductance or capacitance which varies as a function of the position of the movable wall. The selection of the suitable displacement transducer does not depend on the regulating device used.

According to another advantageous development of the invention, the position of the movable wall may be ascertained without contact if the position of the movable wall can be ascertained by an optical sensor element. In this way, the displacement transducer operates without wear.

According to another advantageous development of the invention, the position of the diaphragm may be ascertained particularly cost-effectively if the displacement transducer has a strain gage arranged on the spring element or the diaphragm.

Regulating the fuel pump, together with a spring force of the spring element which is variable over the reciprocating travel of the movable wall could bring about pressure fluctuations on the injection rail of the injection system. According to another advantageous development of the invention, these pressure fluctuations do not lead to a change in the injection quantity at the injection nozzles if the injection times of the injection nozzles of the internal combustion engine can be controlled by a central electronics system as a function of the signals from the displacement transducer.

According to another advantageous development of the invention, a fuel supply system having a fuel filter comprises particularly few components if the fuel filter is arranged in the pressure chamber.

In the case of cyclic operation of the fuel pump, fuel is simply prevented from flowing back from the pressure chamber into the fuel tank by a non-return valve, which closes when the fuel pump is switched off, being arranged in the inlet of the pressure chamber.

These and other features and advantages of the invention will be apparent upon consideration of the following detailed description of the preferred embodiments of the invention, taken in conjunction with the appended drawings.

DETAILED DESCRIPTION OF THE PRESENTLY PREFERRED EMBODIMENT

Figure 1:
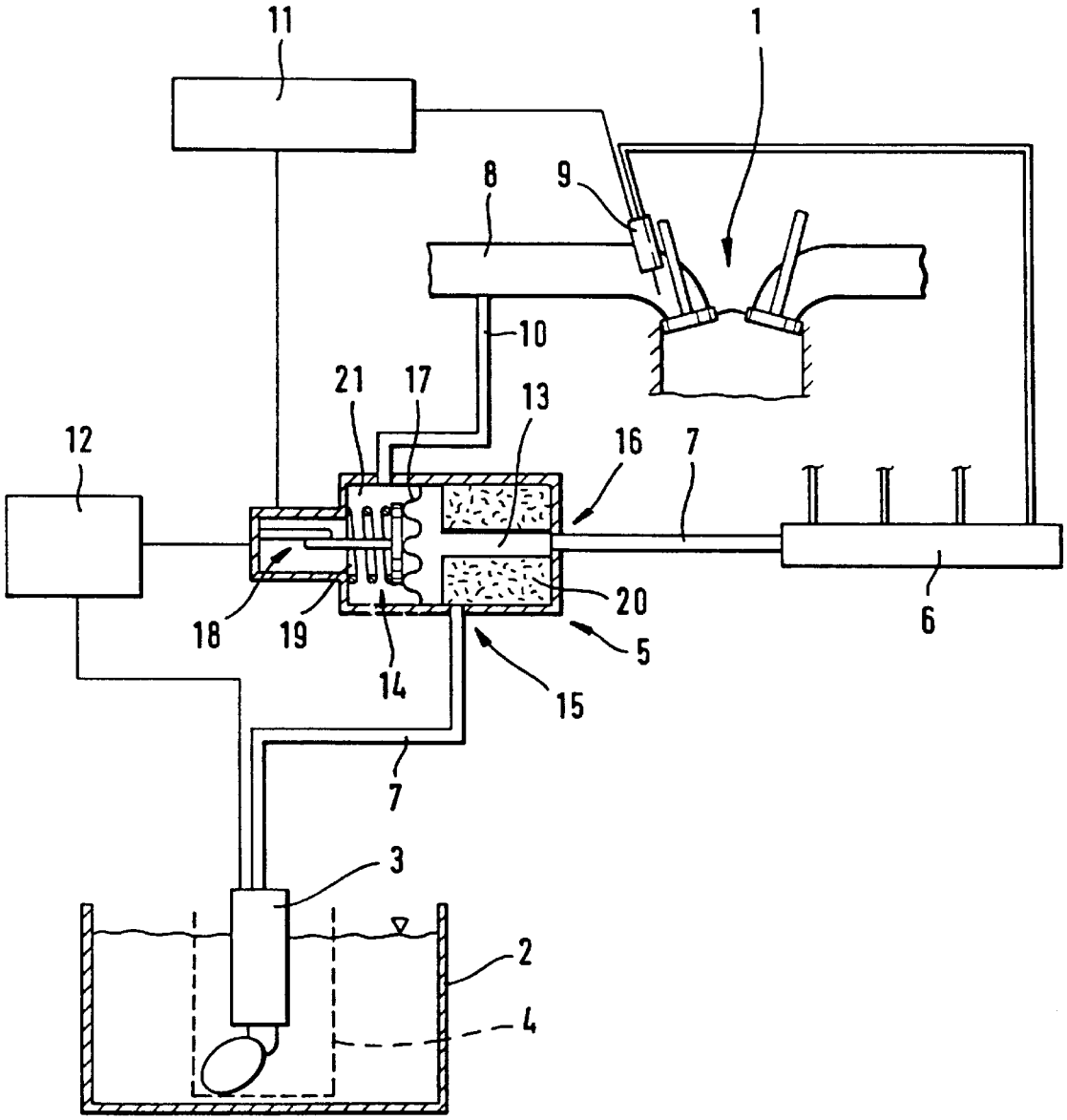
FIG. 1 shows a schematic illustration of a fuel supply system having a pressure maintaining device according to the invention.

FIG. 1 shows a pressure-maintaining device, arranged in a fuel supply system, having a fuel pump 3 which supplies an internal combustion engine 1 with fuel from a fuel tank 2. The fuel pump 3 is arranged in a splash pot 4, and delivers the fuel firstly to a pressure reservoir 5. The pressure reservoir 5 is arranged in a supply line 7 which leads to an injection rail 6 of the internal combustion engine 1. From the injection rail 6, the fuel passes to an injection nozzle 9 arranged in an intake pipe 8. The intake pipe 8 has a connection 10 to the pressure reservoir 5. The injection nozzle 9 is controlled by a central electronics system 11. Arranged beside the pressure reservoir 5 is a regulating device 12 which regulates the fuel pump 3.

The pressure reservoir 5 has a pressure chamber 13, which is bounded by a movable wall 14. The movable wall 14 is located here in a central position. Fuel flows from the fuel pump 3 into the pressure chamber 13 via an inlet 15. The fuel leaves the pressure chamber 13 via an outlet 16 in the direction of the injection rail 6. The movable wall 14 has a diaphragm 17, which is, for example, a reinforced rubber diaphragm. The position of the diaphragm 17, and therefore the volume of the pressure chamber 13, is registered by a displacement transducer 18 and forwarded to the central electronics system 11 and the regulating device 12. The diaphragm 17 is pretensioned toward the pressure chamber 13 by a compression spring 19. A fuel filter 20 is arranged in the pressure chamber 13. That region of the pressure reservoir 5 which faces away from the pressure chamber 13 is constructed as a pressure compensation pot 21, to which the connection 10 to the intake pipe 8 is connected.

During the operation of the internal combustion engine 1, the fuel pump 3 delivers fuel via the pressure chamber 13 to the injection rail 6. The compression spring 19 of the movable wall 14 is dimensioned for an envisaged pressure in the supply line 7. For example, in the case of a pressure rise in the supply line 7, the movable wall 14 moves to the left, and thus enlarges the volume of the pressure chamber 13. In this case, the displacement transducer 18 generates an electrical signal as a function of the position of the movable wall 14, and forwards said signal to the regulating device 12 and the central electronics unit 11. The regulating device 12 then reduces the rotational speed of the fuel pump 3 until the movable wall 14 moves back again into the central position.

Possible pressure fluctuations within the fuel supply system are compensated for by the central electronics unit 11 at the injection nozzle 9, for example via the injection duration.

Figure 2:
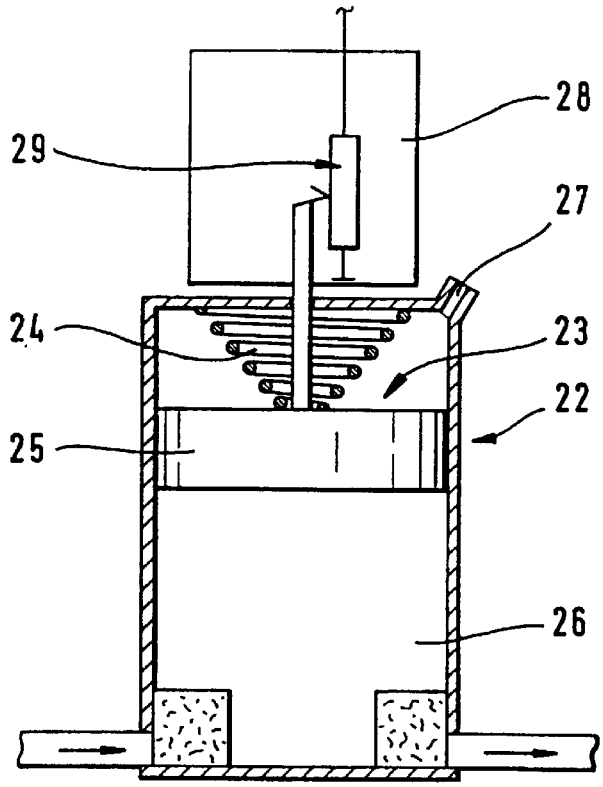
FIG. 2 shows an embodiment of a pressure reservoir.

FIG. 2 shows a further embodiment of a pressure reservoir 22, in which a movable wall 23 has a piston 25 that is prestressed by a compression spring 24. The piston 25 is arranged to be displaceable in the pressure reservoir 22, and as a result is able to vary the volume of a pressure chamber 26. That region of the pressure reservoir 22 which is delimited from the pressure chamber 26 by the piston 25 has a venting hole 27. The position of the piston 25 is registered by a displacement transducer 28 having a potentiometer 29.

Figure 3:
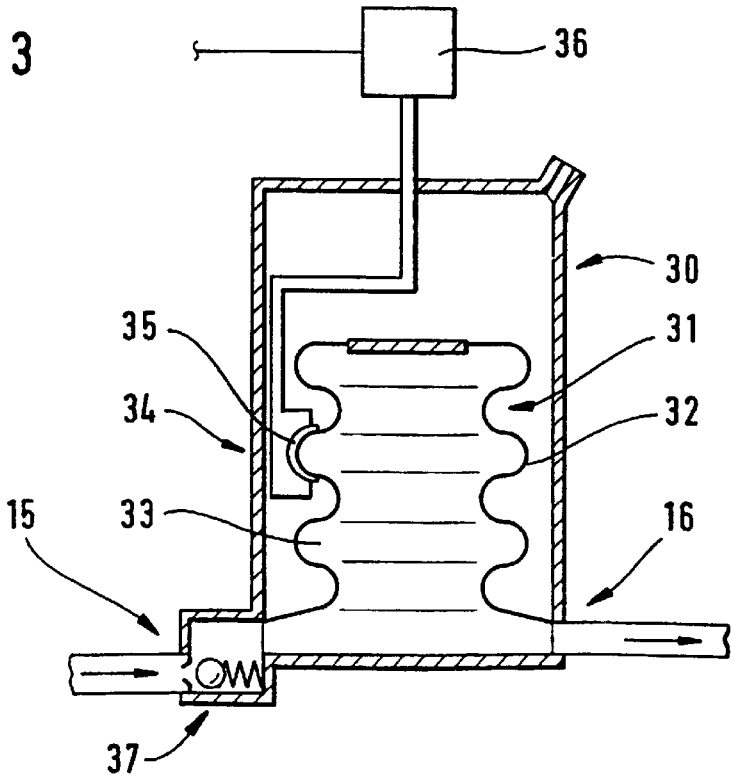
FIG. 3 shows an embodiment of a pressure reservoir.

FIG. 3 shows a pressure reservoir 30, in which a movable wall 31 has a diaphragm 32 made from sheet metal shaped like a bellows. This diaphragm 32 is therefore of self-sprung design and does not need any spring element in order to produce an envisaged pressure in a pressure chamber 33 in the pressure reservoir 30. A displacement transducer 34 has, on the diaphragm 32, a strain gage 35, which forwards electrical signals to a regulating device 36 as a function of the shape of the diaphragm 32 and therefore of the volume of the pressure chamber 33. Arranged in the inlet 15 of the pressure chamber 33 is a non-return valve 37 which, when the fuel pump is switched off, prevents the fuel flowing back into the fuel tank 2 illustrated in FIG. 1.

It is to be understood that a wide range of changes and modifications to the embodiments described above will be apparent to those skilled in the art and are contemplated. It is, therefore, intended that the foregoing detailed description be regarded as illustrative rather than limiting, and that it be understood that it is the following claims, including all equivalents, that are intended to define the spirit and scope of the invention.

What is claimed is:

1. A pressure-maintaining device for a fuel supply system of an internal combustion engine of a motor vehicle, having a pressure reservoir connected to a supply line between a fuel pump and the internal combustion engine, the pressure reservoir having a pressure chamber, a pretensioned, movable wall in order to bound a volume of fuel in the pressure chamber and means for registering the position of the movable wall, it being possible for the fuel pump to be variably regulated by a regulating device as a function of the position of the movable wall, wherein the regulating device is designed to produce a central position of the movable wall.

2. The pressure-maintaining device as claimed in claim 1, wherein the position of the movable wall can be ascertained by an electrical displacement transducer, which is connected to the regulating device, and the delivery of the fuel pump can be regulated by the regulating device.

3. The pressure-maintaining device as claimed in claim 1, wherein the rotational speed of the fuel pump can be varied by the regulating device.

4. The pressure-maintaining device as claimed in claim 1, wherein the pressure chamber has an inlet to connect it to the fuel pump and an outlet to connect it to the internal combustion engine.

5. The pressure-maintaining device as claimed in claim 2, wherein the movable wall is pretensioned by a spring element.

6. The pressure-maintaining device as claimed in claim 5, wherein the movable wall is arranged in the bottom region of the pressure chamber.

7. The pressure-maintaining device as claimed in claim 1, wherein the movable wall is arranged in a side region of the pressure chamber.

8. The pressure-maintaining device as claimed in claim 1, wherein the movable wall has a piston.

9. The pressure-maintaining device as claimed in claim 2, wherein the movable wall is connected to the pressure chamber by means of a diaphragm.

10. The pressure-maintaining device as claimed in claim 9, wherein the diaphragm is a reinforced rubber diaphragm.

11. The pressure-maintaining device as claimed in claim 9, wherein the diaphragm is produced from sheet metal shaped like a bellows.

12. The pressure-maintaining device as claimed in claim 1, wherein the pressure reservoir has, on that side of its movable wall which faces away from the pressure chamber, a pressure compensation pot, which has a connection to an intake pipe of the internal combustion engine.

13. The pressure-maintaining device as claimed in claim 2, wherein the displacement transducer has a potentiometer.

14. The pressure-maintaining device as claimed in claim 1, wherein the position of the movable wall can be ascertained by an optical sensor element.

15. The pressure-maintaining device as claimed in claim 5, wherein the displacement transducer has a strain gage arranged on the spring element.

16. The pressure-maintaining device as claimed in claim 2, wherein the injection times of the injection nozzles of the internal combustion engine can be controlled by a central electronics system as a function of the signals from the displacement transducer.

17. A pressure-maintaining device as claimed in claim 1, wherein a fuel filter is arranged in the pressure chamber.

18. The pressure-maintaining device as claimed in claim 4, wherein a non-return valve, which closes when the fuel pump is switched off, is arranged in the inlet of the pressure chamber.

19. The pressure-maintaining device as claimed in claim 9, wherein the displacement transducer has a strain gage arranged on the diaphragm.

20. A pressure-maintaining device for a fuel supply system of an internal combustion engine of a motor vehicle comprising:

a fuel pump;

a supply line connecting the fuel pump to the internal combustion engine;

a pressure reservoir connected to the supply line, the pressure reservoir comprising:

a pressure chamber;

a movable wall within the pressure chamber that bounds a volume of fuel in the pressure chamber;

wherein the pressure chamber acts as a buffer of fuel by bounding a sufficient volume of fuel to supply fuel to the engine when the fuel pump is undersupplying fuel to the engine and to retain a volume of fuel when the fuel pump is oversupplying fuel to the engine; and a fuel pump regulator that determines the position of the movable wall and variably regulates the fuel pump as a function of the position of the movable wall.

21. The pressure-maintaining device as claimed in claim 20, wherein the position of the movable wall can be ascertained by an electrical displacement transducer that is connected to the fuel pump regulator and the fuel pump can be regulated by the fuel pump regulator.

22. The pressure-maintaining device as claimed in claim 20, wherein the rotational speed of the fuel pump is varied by the fuel pump regulator.

23. The pressure-maintaining device as claimed in claim 21, wherein the movable wall is pretensioned by a spring to maintain a central position of the moveable wall within the pressure chamber.

24. The pressure-maintaining device as claimed in claim 20, wherein the movable wall includes a piston.

25. The pressure-maintaining device as claimed in claim 20, wherein the movable wall is connected to the pressure chamber by means of a diaphragm.

26. The pressure-maintaining device as claimed in claim 20, wherein the pressure reservoir has, on a side of its movable wall that faces away from the pressure chamber, a pressure compensation pot that has a connection to an intake pipe of the internal combustion engine.

27. The pressure-maintaining device as claimed in claim 23, wherein the displacement transducer has a strain gage arranged on the spring.

28. The pressure-maintaining device as claimed in claim 21, wherein injection times of injection nozzles of the internal combustion engine can be controlled by a central electronics system as a function of the signals from the displacement transducer.

29. A pressure-maintaining device as claimed in claim 20, wherein a fuel filter is arranged in the pressure chamber.

30. The pressure-maintaining device as claimed in claim 20, wherein a non-return valve, which closes when the fuel pump is switched off, is arranged in an inlet of the pressure chamber.

* * * * *